US007971623B2

(12) United States Patent
Barnard et al.

(10) Patent No.: US 7,971,623 B2
(45) Date of Patent: Jul. 5, 2011

(54) ADJUSTABLE GARAGE DOOR WINDOW FRAME AND METHOD OF INSTALLATION

(75) Inventors: Bob R. Barnard, Colleyville, TX (US); David M. Barnard, Colleyville, TX (US)

(73) Assignee: National Door Industries, Inc., Fort Worth, TX (US)

( * ) Notice: Subject to any disclaimer, the term of this patent is extended or adjusted under 35 U.S.C. 154(b) by 161 days.

(21) Appl. No.: 12/417,215

(22) Filed: Apr. 2, 2009

(65) Prior Publication Data

US 2010/0251635 A1 Oct. 7, 2010

(51) Int. Cl.
*E06B 3/72* (2006.01)

(52) U.S. Cl. ..... 160/116; 160/180; 52/455

(58) Field of Classification Search ..... 160/180; 52/656.2, 204.54, 204.56, 208, 455; 49/505
See application file for complete search history.

(56) References Cited

U.S. PATENT DOCUMENTS 2,853,161 A * 9/1958 Mascari ..... 52/212
2,902,727 A * 9/1959 Samolis ..... 52/204.54
4,735,025 A * 4/1988 Day ..... 52/217
4,787,184 A * 11/1988 Boidron ..... 52/217
5,189,862 A * 3/1993 Lafleur ..... 52/771
5,369,922 A * 12/1994 Hansen ..... 52/204.54
5,596,852 A * 1/1997 Schiedegger ..... 52/212
6,272,801 B1 * 8/2001 Suh ..... 52/211
6,931,810 B2 * 8/2005 Beaudoin et al. ..... 52/455
7,107,736 B2 * 9/2006 Barnard ..... 52/745.15
7,430,836 B2 * 10/2008 Sibbett ..... 52/208
7,448,174 B2 * 11/2008 Krochmal et al. ..... 52/204.54
2003/0019178 A1 * 1/2003 Wang Chen ..... 52/455
2003/0056442 A1 * 3/2003 Gerard ..... 49/504
2004/0068942 A1 * 4/2004 Krochmal et al. ..... 52/204.71
2010/0251635 A1 * 10/2010 Barnard et al. ..... 52/127.6

* cited by examiner

*Primary Examiner* — Blair M. Johnson
(74) *Attorney, Agent, or Firm* — Charles D. Gunter, Jr.

(57) ABSTRACT

A window frame assembly for installation within a garage door having front and rear exposed surfaces and one or more window openings. The assembly includes front and rear window frame members of injection molded plastic which are installed within the door opening on the front and rear exposed surfaces. The window frame members have alignment elements to assist in assemble and have engagement elements located about their peripheries which snap together in mating fashion to mount the frame members within the window opening. The engagement elements are adjustable to accommodate garage door panels of varying thicknesses and window panes of varying thicknesses. The engagement elements are also disengageable with a hand tool to separate the frame members and remove the members from the window opening.

6 Claims, 7 Drawing Sheets

ADJUSTABLE GARAGE DOOR WINDOW FRAME AND METHOD OF INSTALLATION

BACKGROUND OF THE INVENTION

A. Field of the Invention

This present invention relates to decorative molding assemblies for framing openings of residential or commercial structures, and more specifically to a decorative window frame assembly for decoratively framing a garage door window opening of a residential or commercial garage door.

B. Description of the Prior Art

Modern garage door systems are typically comprised of doors having horizontally arrayed sections joined by hinges into a door unit. The door is mounted in a vertical track which curves upwardly into a horizontal position so that the door may be opened upwardly and supported horizontally in an open position. The sections are joined by the hinges along the longitudinal edges of the sections so that the overall door structure will generally conform to the radius of curvature of the track as it changes from vertical to horizontal. Customarily, each of the sections are fabricated separately and thereafter hinged together along a longitudinal edge to provide the complete overhead door structure. Historically, the sections are fabricated from a galvanized and/or prepainted sheet metal stock which has been rolled or otherwise formed into the particular section facing, web and parallel interior flange configurations. Vertical stiles are usually secured to the section facing and interior flanges at spaced locations by spot-weld or rivet techniques. Most prior art overhead door systems use hinges that are secured directly to the section stiles. While a majority of garage doors continue to be manufactured from mild steel stock, some manufacturers offer overhead doors made from synthetic materials such as from various types of vinyl.

Molding assemblies are used in a variety of applications to frame or "surround" doorways, windows, patio doors, garage doors etc., to provide a decorative, aesthetically appealing framing for the opening. In recent years, such molding assemblies have been manufactured from plastics and are often injection molded. In general, plastics provide significant advantages in most installations. For example, molding or framing assemblies or components thereof manufactured from plastic are low in maintenance. Plastic molding assemblies are not susceptible to moisture and therefore will not typically decay, warp or splinter. Advantageously, plastic surround molding assemblies or components thereof can be sawed, drilled, glued or nailed. Still further, during the manufacture of plastic molding assemblies, plastic can be tinted with dyes or other materials to provide molding assembly components which are of desired colors, thus obviating the need for painting prior or subsequent to installation on a structure. Molding plastics are also available as UV stable materials which are resistant to degradation upon exposure to the surrounding environment.

Particularly in the area of residential garage doors, a number of manufacturers offer plastic window frame assemblies which are fitted within openings provided in the garage door and which typically feature a central opening which contains a transparent pane which may be of glass, plastic or such newer materials as acrylics. The central opening in the window frame assembly may also contain a decorative trim member which is sandwiched between the transparent pane and other framing components.

Historically, prior art window frame assemblies for overhead garage doors were typically assembled using what is referred to in the industry as a "stick built" assembly technique using mounting clips. A front frame member of injection molded plastic is received into the door opening from the front side. The front frame member has a central opening for receiving the window pane, decorative trim, etc. The front frame member and pane are then retained in position by hammering four mounting clips, sometimes referred to as "stick" strips, on the back side of the door. The front frame member has an inner periphery equipped with a locking rail which matingly engages a groove in the locking strips. The locking strips have corners which are diagonally cut and fit. Once hammered into position, it was generally necessary to cut off the locking strips in order to disassemble the window frame components in order to, for example, replace the pane. Thus, while the prior art technique was generally effective in securing the window frame assembly to the door structure, the use of stick built framing techniques added to the time and expense associated with installing the complete assembly. Once installed, should one component of the surrounding molding assembly need to be removed or replaced, the use of such an assembly technique complicated the task of removing and replacing the sub-components of the window frame assembly.

Applicant's issued U.S. Pat. No. 7,107,736, issued Sep. 19, 2006, was an improvement to the aforementioned "stick built" assembly technique. In the technique described in the '736 patent, a front and rear window frame members of injection molded plastic were provided having engagement elements located about the peripherals which snap together in mating fashion to mount the frame members within the window opening. The engagement elements are also disengageable with a hand tool to separate the frame members and remove the members from the window opening, as to replace a window pane.

Despite the advantages offered by the window frame construction described in the '736 patent, a need continued to exist in the area of garage door window frame construction and installation techniques.

For instance, it would be advantageous to provide a window frame construction of molded plastic construction with snap engagement elements which would be adjustable to accommodate garage doors of varying thicknesses, as well as various window pane thicknesses.

It would also be advantageous to provide such a garage door window flame construction which would offer additional ease of installation, as by providing alignment elements on the respective frame members to assist in alignment of the members during installation and to insure minimal twisting between the exterior and interior frame members during assembly.

Another need would be to provide such a window frame construction with snap engagement elements, the elements offering additional ease of disengagement by using a simple hand tool, such as a screw driver.

Another need which exists with the presently existing garage door window flame designs concerns the fact that the assembled frame should provide even pressure on all four sides of the window glazing which surrounds the outer periphery of the window frame. Likewise, the preferred frame construction would ensure that constant and even pressure are maintained on the garage door panel by the assembled frame, making sure the exterior frame member maintains contact with the outside of the garage door panel around the full perimeter of the frame.

SUMMARY OF THE INVENTION

Accordingly, it is an object of the present invention to provide a window frame assembly for an overhead garage door which provides a decorative and aesthetically pleasing appearance, while securely supporting the various window frame components of the overall assembly.

It is a further object to provide a versatile window flame assembly that can accommodate various other trim components that may abut the frame components.

It is yet another object of the present invention to provide a window frame assembly in which the components of the window frame assembly include engageable and reversibly disengageable interlocking elements which are used to interconnect the front and rear window frame members of the assembly together. In this manner, the decorative window flame assembly can be securely, yet releasably held to the structure, while reducing the time required for assembly and without requiring the use of nails, or other like fastening elements.

Accordingly, it is another object of the present invention to provide such a window frame assembly which can be secured to the structure in a secure fashion and yet which can be released and removed with the use of a simple hand tool such as a screw driver.

Another object of the invention is to provide a window frame construction of molded plastic construction with snap engagement elements which would be adjustable to accommodate garage doors of varying thicknesses, as well as various window pane thicknesses.

Another object of the invention is to provide such a garage door window frame construction which would offer additional ease of installation, as by providing alignment elements on the respective frame members to assist in alignment of the members during installation and to insure minimal twisting between the exterior and interior frame members during assembly.

Another object of the invention is to provide such a window frame construction which is designed in such a way as to provide even pressure on all four sides of the window glazing which surrounds the outer periphery of the window frame and which also ensures that constant and even pressure are maintained on the garage door panel by the assembled frame, making sure the exterior frame member maintains contact with the outside of the garage door panel around the full perimeter of the frame.

In view of the foregoing, it would be an advancement in the art to provide a garage door window system having a molded plastic frame which is assembled in snap-fit fashion, which can be quickly and easily disassembled, and that is characterized by the absence of mounting clips to accommodate easy replacement of the window. Such a novel garage door window system is disclosed and claimed herein.

The window frame assembly of the invention is used to install a transparent pane and/or a decorative trim component within an opening provided in a metal, overhead garage door having front and rear exposed surfaces separated by a door thickness, and at least one window opening therein. A front window frame member is formed in one piece of a synthetic, polymeric material and has a periphery sized to circumscribe the window opening from the front exposed surface of the door. A rear window frame member is also formed in one piece of a synthetic polymeric material and has a periphery sized to circumscribe the window opening from the rear exposed surface of the door. The front and rear window frame members have engagement elements located about the peripheries thereof which snap together in mating fashion to thereby mount the frame members within the window opening, the engagement elements also being disengageable with a hand tool to separate the frame members and remove the members from the window opening.

In one preferred form of the invention, the engagement elements include at least one ratchet element on a selected one of the front and rear window frame members and a series of mating ratchet stops on the other of the respective front and rear frame members, whereby the front and rear window frame members snap together between a disengaged position and a series of engaged positions of varying width designed to accommodate garage doors of varying thicknesses. Preferably, a plurality of ratchet elements are provided on the selected window frame member, circumscribing the periphery thereof.

A series of alignment elements are also preferably provided on the front and rear window frame members, respectively, the preferred alignment elements including a T-shaped bar on a selected one of the front and rear window frame members and a mating T-shaped channel provided on the other of the respective front and rear frame members. The alignment elements are used to provide ease of alignment between the front and rear frame member during assembly and to ensure minimal twisting of the window frame members during assembly. Preferably, a plurality of the alignment elements are provided about the peripheries of the window frame members, interspersed between the ratchet elements, the alignment elements further serving to ensure the continued secure engagement of the ratchet elements upon assembly.

The rear window frame members can also be provided with a flexible compression leg that runs about an inside perimeter of the rear window frame, the compression leg contacting and compressing the window pane along a peripheral edge thereof, to thereby ensure a constant pressure upon the pane upon assembly.

If desired, a series of phantom holes can be provided on the interior frame member, the phantom holes being aligned with mating screw bosses provided on the front frame member, whereby drilling through the phantom holes on the rear window frame allows screws to be installed into the bosses provided on the front frame member.

To facilitate the disassembly of the window frame members, the rear frame member is provided with openings provided therein in alignment with the engagement elements, the openings providing access to the engagement elements so that a hand tool can be inserted within the openings to disengage the ratchet elements from the ratchet stops to allow the disassembly of the window frame members from within the opening in the garage door. To accomplish the task of disassembling the window frame members, as for installing a replacement window pane therebetween, a hand tool is first inserted into the provided openings in the rear frame member and is used to disengage the snap-fit ratchet elements. The two window flame members are then separated, followed by removing the existing transparent pane from between the two window flame members. A replacement window pane can then be installed between the two window frame members, followed by again engaging the window frame members within the garage door opening. If desired, a decorative trim member can also be installed within the window frame openings, in addition to the transparent pane.

Additional objects, features and advantages will be apparent in the written description which follows.

DETAILED DESCRIPTION OF THE INVENTION

As discussed briefly above, commercially available garage doors used at the present time are typically assembled from a series of door sections aligned horizontally in an edge-to-edge configuration to form a vertically oriented door for the garage opening. The sections are hinged together as a series along their abutting, horizontal edges to allow the garage door to be raised upwardly in a track to an overhead, horizontal position. The track includes a curved section between the vertical and the overhead positions. The hinged sections allow the garage door to traverse this curved section during the transition of the garage door from the vertical to the overhead, horizontal position.

Figure 1:
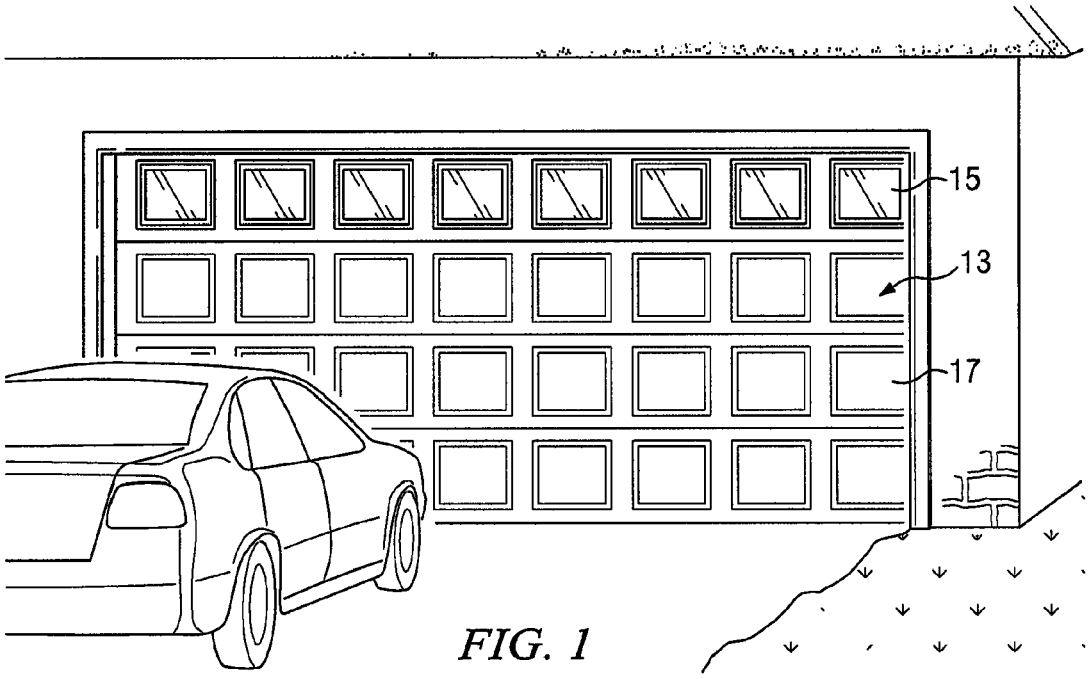
FIG. 1 is partial perspective view of a garage door having window frame assemblies of the invention installed therein.

In many of the presently available garage door systems, a series of plain or decorative windows are incorporated the garage door, typically within an upper section of the garage door. These windows are formed in individual panels of the upper section and provide daylight illumination of the closed garage and can provide a decorative appearance, as well. A window opening is formed in each panel. Applicant's FIG. 1 shows a typical garage door 13 having window assemblies 15 installed into openings provided in a top section thereof. The garage door illustrated in FIG. 1 is shown in a simplified, stylized form for ease of illustration. Those skilled in the art will understand that such doors are typically provided, for example with a decorative surface treatment which is designed to mimic conventional wood panels while structurally imparting a certain degree of dimensional stability to garage door section.

Conventionally, a rather cumbersome window and window framework system is inserted in the opening provided in the garage door. In the prior art assembly technique, an exterior frame is inserted into a window opening followed by a window pane of glass or plastic. In many cases, a decorative overlay or "trim" (not shown) is mounted in the exterior frame. The exterior frame is then mounted to garage door section while the decorative overlay and windowpane are retained in the exterior frame by a plurality of mounting strips or clips. The mounting clips are conventional devices and are configured with a generally U-shaped cross section having a series of internally located, longitudinal ridges that are designed to engage corresponding longitudinal ridges on the peripheral lip of exterior frame. The clips are designed such that the edges of the U-shaped cross section are resiliently urged together thereby enabling the mounting clips to securely engage the longitudinal ridges of the peripheral lip of exterior frame. This feature requires that a hammer must be used to force the mounting clips into engagement with exterior frame. Once engaged, the mounting clips are very difficult to remove in the event any component of prior art window frame assembly requires replacement and, even if removed, experience has shown that the mounting clips are usually irreparably damaged during the removal process.

The number of components that constitute such a prior art window frame assembly and their function result in a design that is difficult to assemble as well as to disassemble. Also, the increased costs involved with the various components along with the labor required for its assembly limit its universal application for all garage door installations. For example, it was sometimes necessary in the prior art assembly techniques to mount the window frame assembly into a section of the garage door before the section was assembled into the completed garage door. The garage door section would be placed onto a padded surface and the various components of prior art window would be mounted thereon. The final step of the mounting procedure required that the mounting clips be vigorously pounded into place using a heavy mallet, necessitating the use of a padded surface during the mounting procedure. An additional disadvantage of the prior art window frame design and assembly technique is that the mounting clips when viewed from the garage interior, not only sag and twist but are notoriously difficult to fit with a precision, ninety-degree fit at the abutting corners of clips, especially when the mounting clips must be vigorously hammered into place.

As has been briefly mentioned, Applicant's issued U.S. Pat. No. 7,107,736, issued Sep. 19, 2006, was an improvement to the previously described "stick built" assembly technique. Applicant's improved window assembly utilized a front and rear window frame members of injection molded plastic which were provided having engagement elements located about the peripherals which snap together in mating fashion to mount the frame members within the window opening. The engagement elements were also disengageable with a hand tool to separate the frame members and remove the members from the window opening, as to replace a window pane. This type of garage door window assembly offered a number of advantages over the prior art assembly technique by virtue of the ease and simplicity of assembly. The frame members were easily snapped into position in the window opening and could be easily released as well with a simple hand tool, such as a screwdriver blade, so that the frame assembly could be disassembled for repair or replacement.

The present invention is concerned with further improvements and refinements in the window frame assembly described in Applicant's issued U.S. Pat. No. 7,107,736. The combination garage door and window frame of the invention will now be described with respect to FIGS. 1-9 of the drawings. As previously mentioned, FIG. 1 shows a typical residential garage door which includes the metal overhead garage door 13 having front and rear exposed surfaces 17, 19 (FIGS. 1 and 6) and at least one window opening (shown generally at 21 in FIG. 6) therein.

Figure 2:
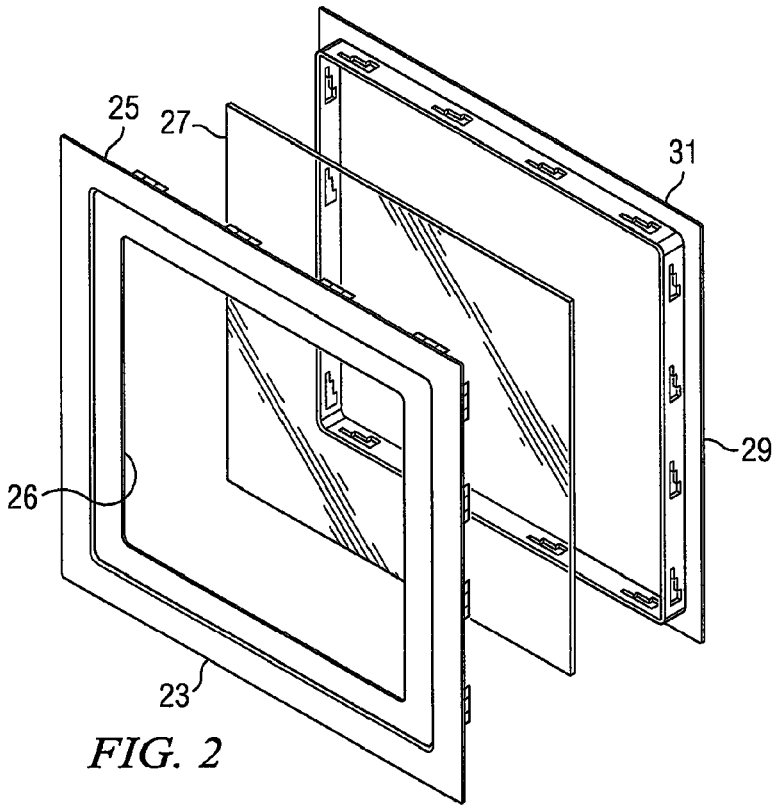
FIG. 2 is an exploded view of a window frame assembly of the invention showing the front and back frame members with a transparent pane located therebetween.

As shown in FIG. 2, a front window frame member 23 is preferably formed in one piece of synthetic, polymeric material and has a periphery 25 which is sized to circumscribe the window opening 21 from the front exposed surface 17 of the door 13. The member 23 also has a window pane opening 26 for receiving a transparent pane 27. In the most preferred embodiment, the front frame member 23 is injection molded from a synthetic plastic such as a commercially available polyurethane or suitable polyolefin material.

A rear window frame member 29 is also formed in one piece of injection molded plastic and has a periphery 31 which is sized to circumscribe the window opening 21 from the rear exposed surface of the door 13. The front and rear window frame members have engagement elements located at selected spaced locations about the peripheries 25,31 thereof which snap together in mating fashion to allow the frame members to be mounted within the window opening 21. As will be explained, the engagement elements are also preferably disengageable with a hand tool, such as a screwdriver, to separate the frame members and remove the members from the window opening 21.

Figure 3:
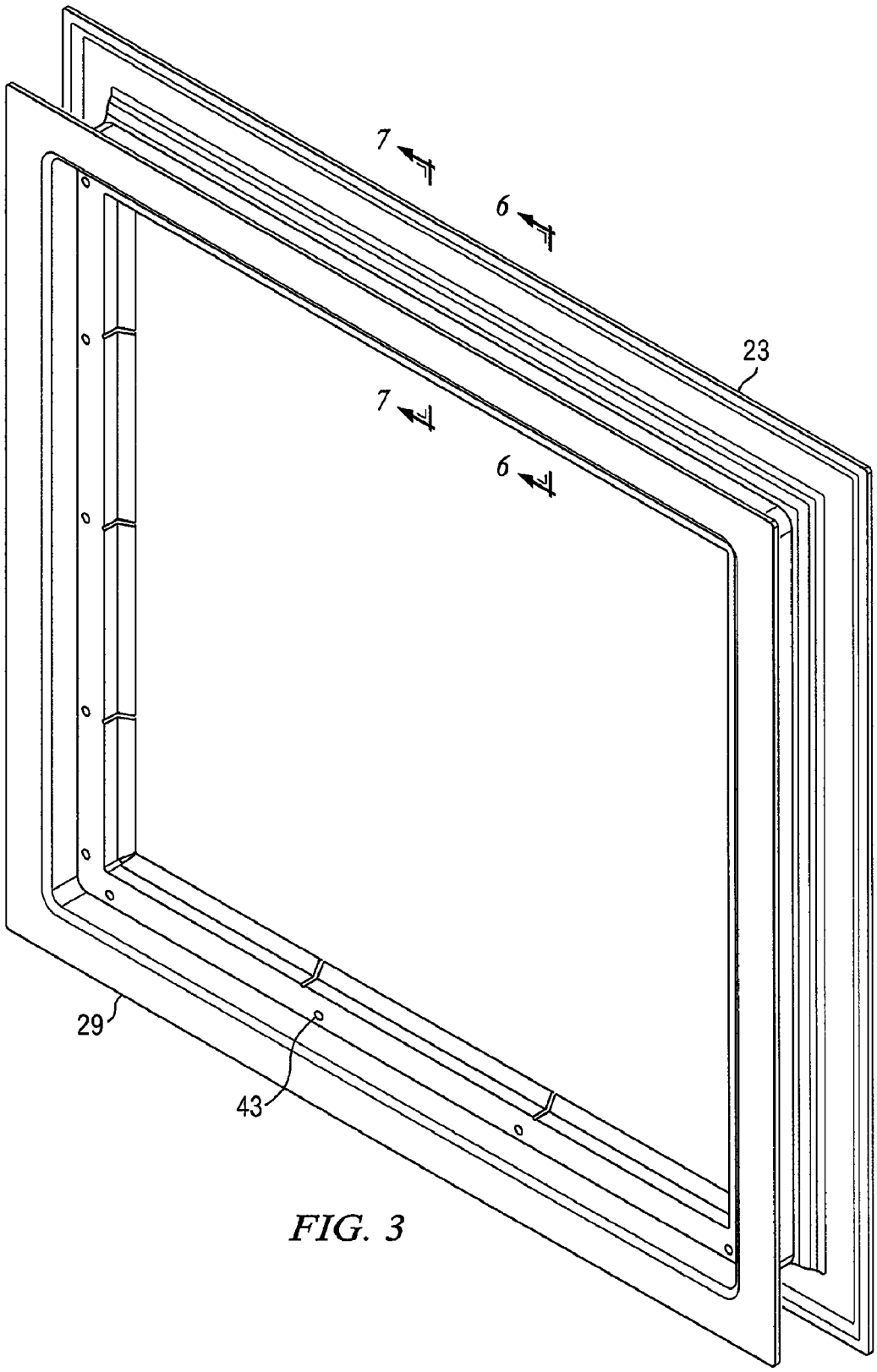
FIG. 3 is a perspective view of the frame of the invention with the front and back frame members shown being snapped together.
Figure 4:
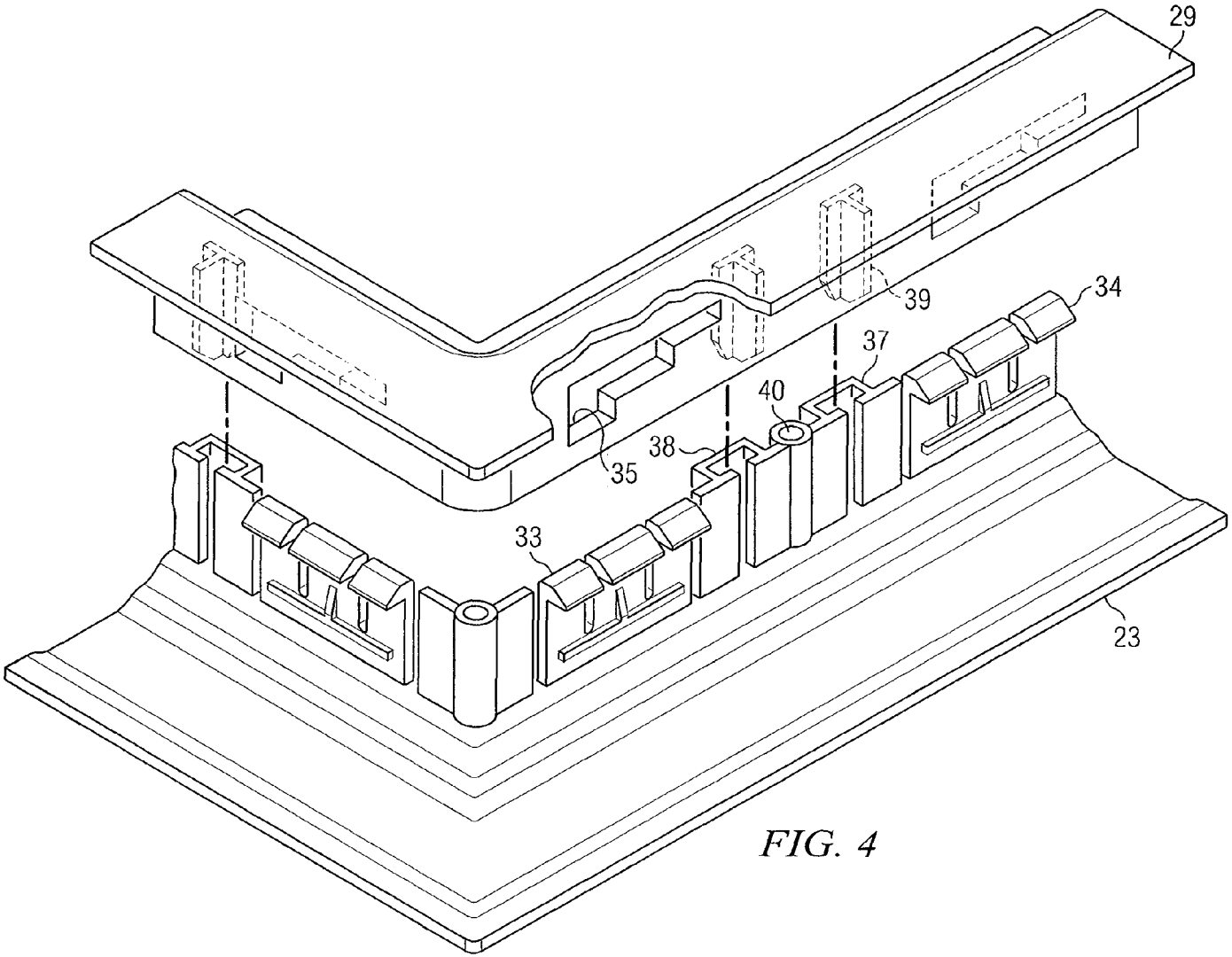
FIG. 4 is a close-up view of a portion of the frame of the invention showing the front and back frame members in exploded fashion with the alignment elements of the front frame member being shown in phantom lines for easer of illustration.
Figure 5A:
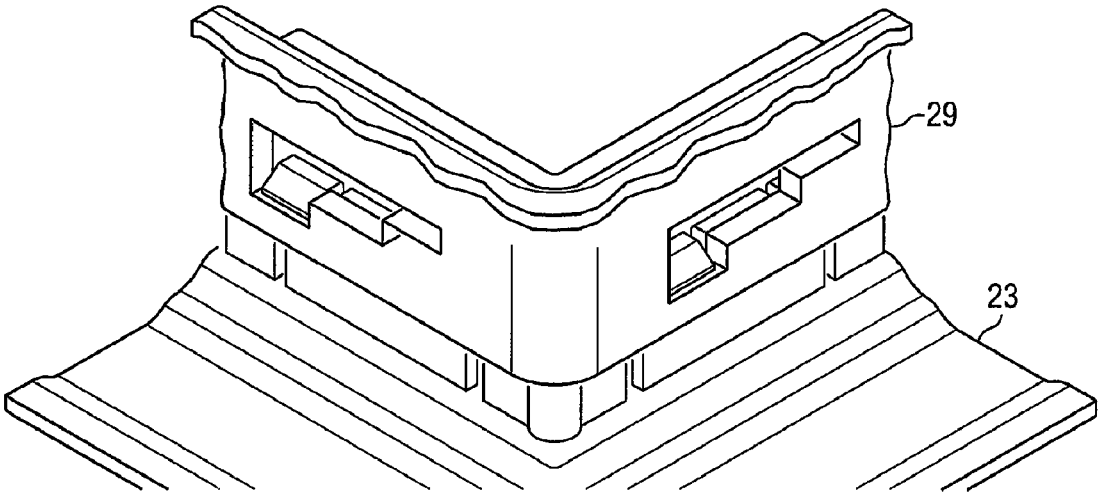
FIGS. 5A-5C are close-up views of a portion of the assembled frame of the invention, showing the various positions of the snap-together assembly elements which allow window panes of various thicknesses to be accommodated.
Figure 5B:
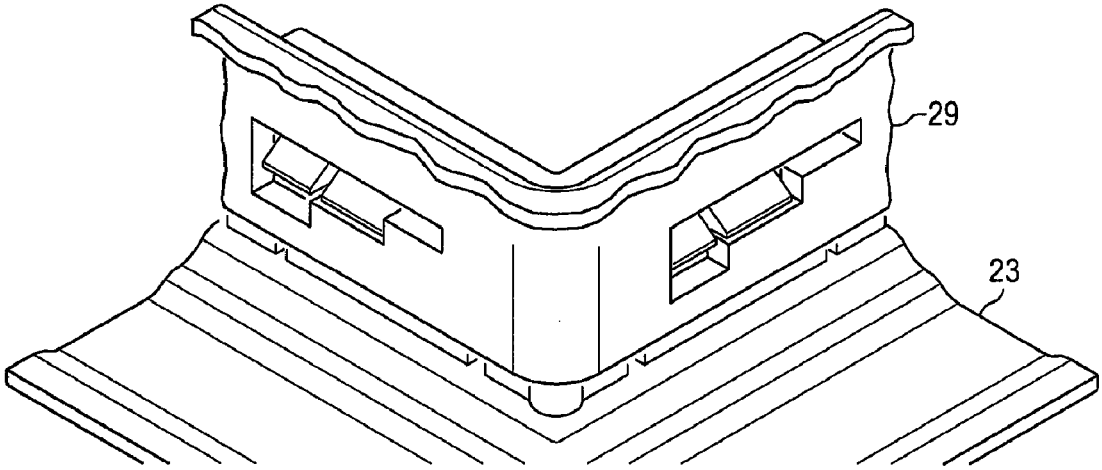
Figure 5C:
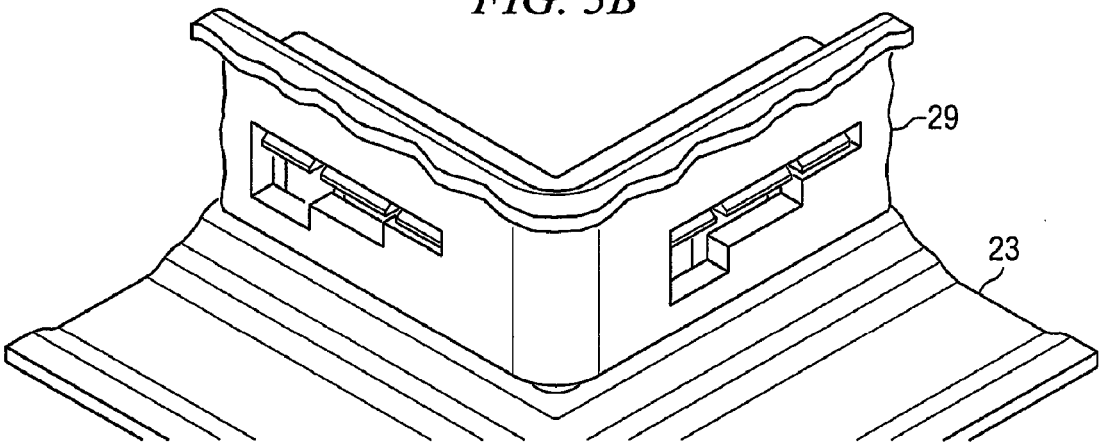

FIG. 3 is an isolated view of the front and back window frame members 23, 29 fully assembled, as viewed from the rear of the assembly. FIG. 4 shows the front and back frame members 23, 29 prior to being snapped together with a transparent pane sandwiched therebetween. FIG. 5A-5C show portions of the front and rear frame members during the assembly as they are snapped together.

In the preferred form of the invention illustrated in FIG. 4, the engagement elements are L-shaped tabs or detents 33 which are molded in the plastic of the frame member and which mate with aligned stepped recesses or lips 35 provided on the other respective frame member. In this way, the respective detents 33 act as ratchet elements with the lips 35 acting as ratchet stops on the other of the respective frame members. In this way, the front and rear frame members 23, 29 snap together between a disengaged position (shown in FIG. 4) and a series of engaged positions (shown in FIGS. 5A-5C) of varying widths which are designed to accommodate garage doors of varying thicknesses. In the preferred form of the invention illustrated in FIG. 4, the ratchet tabs 33 are arranged in spaced fashion about the periphery of the front frame member 23. In the case of the frame shown in FIG. 4, groups of three ratchet tabs 33 each are spaced about the frame periphery.

As will also be appreciated from FIG. 4, the front and rear frame members 23, 29 are also provided with a series of alignment elements, 37, 39, respectively. The alignment elements take the form of a T-shaped bar 39 on a selected one of the front and rear window frame members and a mating T-shaped channel 37 provided on the other of the respective front and rear frame members. The bars and channels, 37, 39, provide ease of alignment between the front and rear frame member during assembly and to ensure minimal twisting of the window frame members during assembly. The bars and channels are located at evenly spaced locations about the periphery of the respective frame members, being interspersed with the ratchet elements. In the example shown in FIG. 4, molded alignment channels 37, 38 are located between engagement element groups 33, 34, and also span a screw boss opening 40. The alignment elements further serve to ensure the continued secure engagement of the ratchet elements 33, 35, upon assembly.

Figure 6:
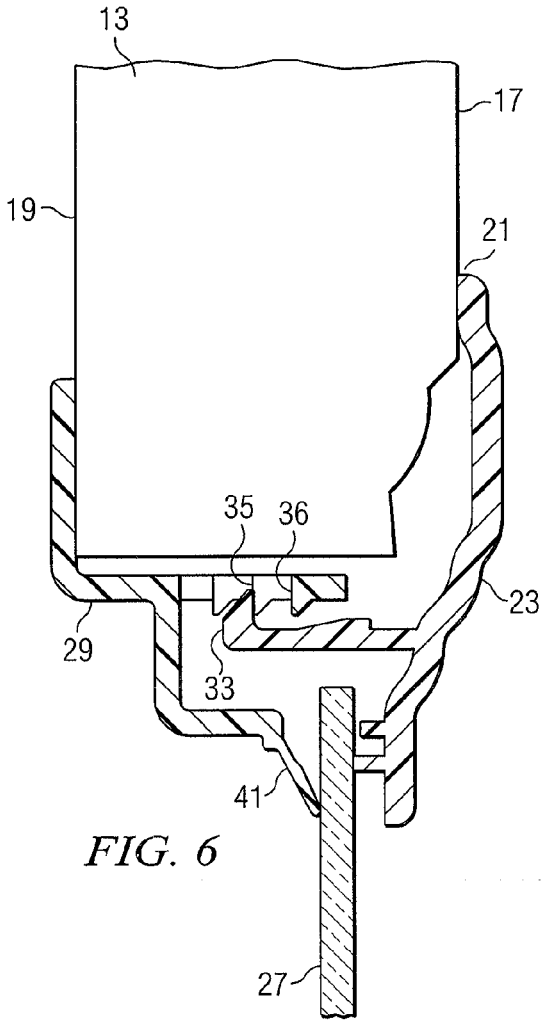
FIGS. 6 and 7 are side, cross-sectional views of the window frame of the invention, taken along lines 6-6 and 7-7 in FIG. 3, respectively.
Figure 7:
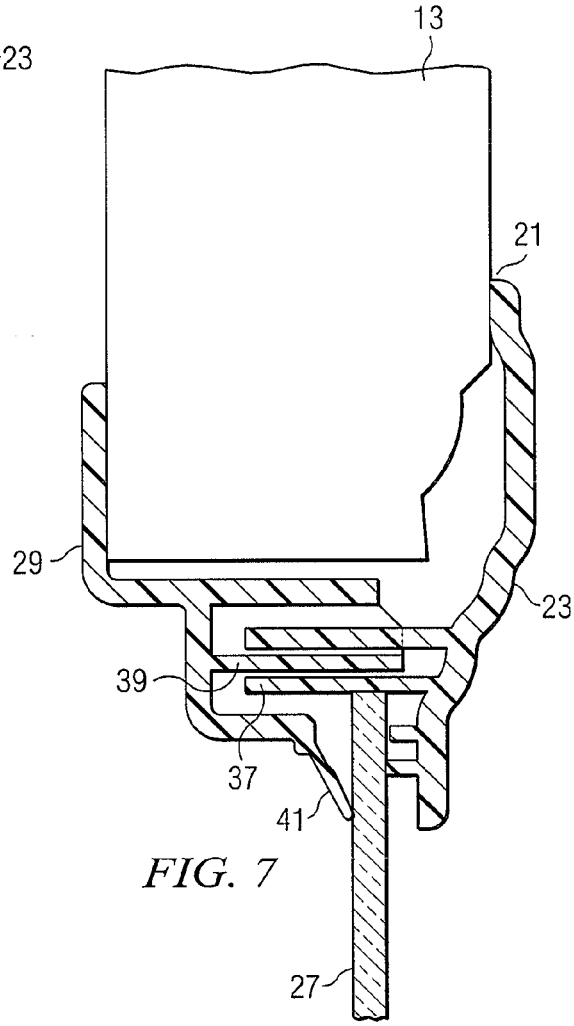
Figure 8:
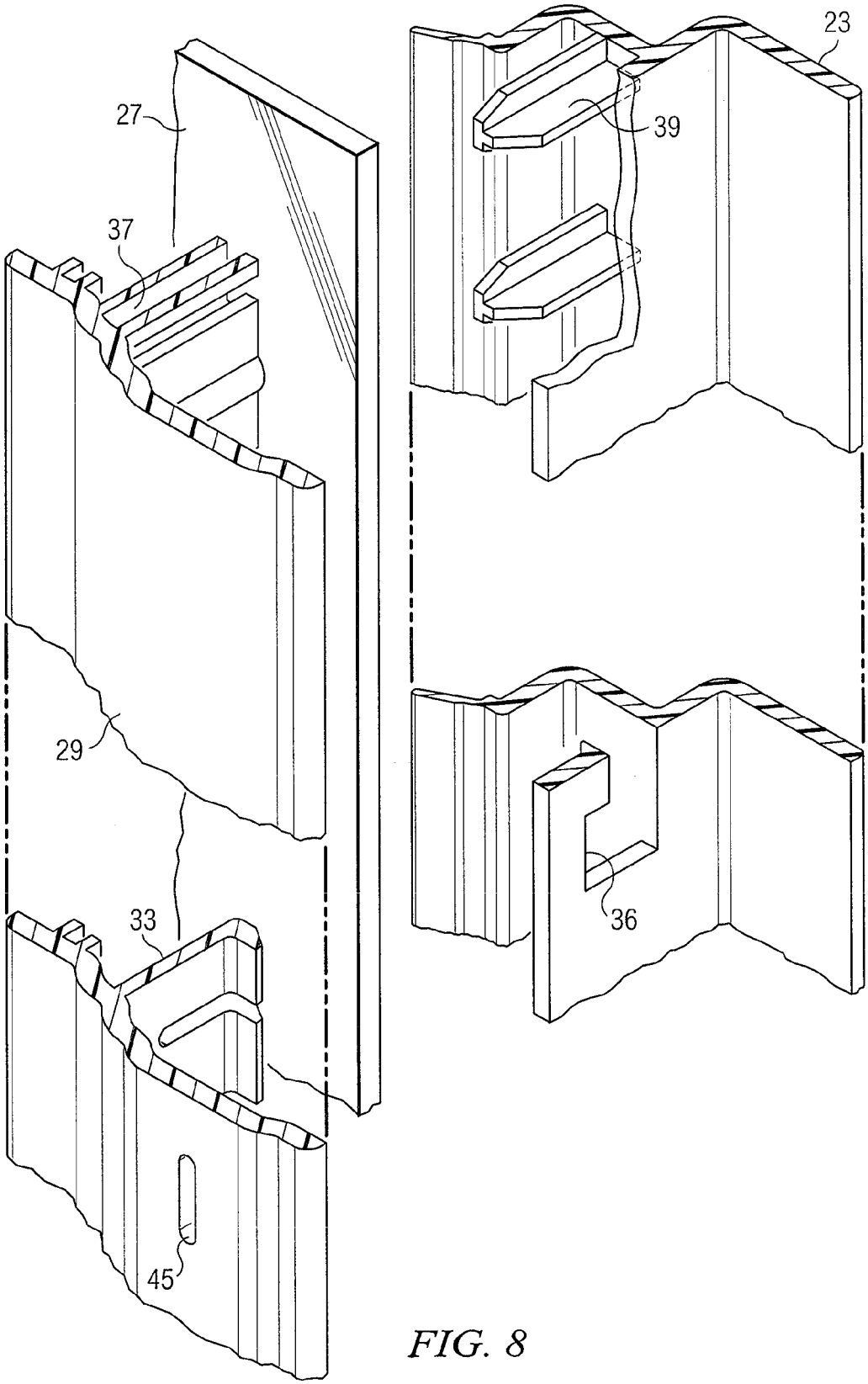
FIGS. 8 and 9 are partial views of the front and rear window frame members of the invention, showing the assembly thereof, with a transparent window pane located therebetween and illustrating the alignment elements and snap-locking elements of the respective frame members.
Figure 9:
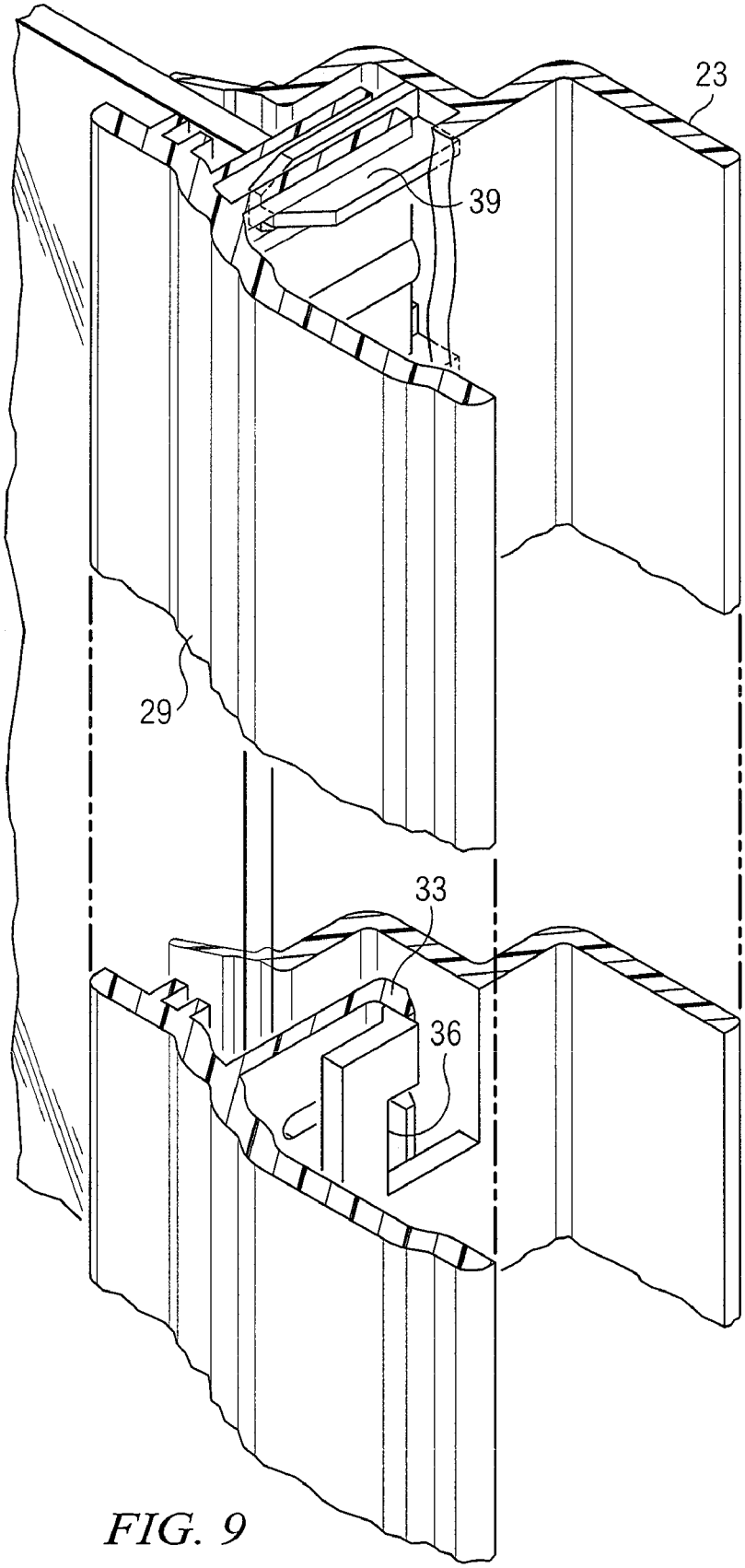

FIGS. 6 and 7 show the front and rear frame members in partial cross section, with FIG. 6 showing the ratcheting engagement of the tabs 33 within the ratchet stops 35. In the example shown in FIG. 6, the tab 33 is engaged within the second ratchet stop. If a thinner door panel 13 had been present, the tab 33 would have engaged the first stop 36. The cross sectional view shown in FIG. 7 illustrates the action of the alignment elements 37, 39 which assist in the assembly of the two frame members. FIGS. 8 and 9 also show the frame members 23, 29, in exploded fashion, prior to assembly and then fully assembled, and further illustrated the mating engagement of the ratcheting elements and the alignment elements.

As will also be appreciated from FIGS. 6 and 7, the rear window frame member are provided with a flexible compression leg or flange 41 that runs about an inside perimeter of the rear window frame. The compression leg 41 contacts and compresses the window pane 27 along a peripheral edge thereof, to thereby ensure a constant pressure is applied to the pane upon assembly.

To further ensure the integrity of the assembled window frame assembly, a series of phantom holes can be provided on the interior frame member (shown as 43 in FIG. 3). The phantom holes 43 are aligned with mating screw bosses (such as boss 40 in FIG. 4) provided on the front frame member, whereby drilling through the phantom holes on the rear window frame allows screws to be installed into the bosses provided on the front flame member. The thus installed screws, in conjunction with the engagement elements 33, 35, make the assembly a much stronger and more durable frame package than the prior art designs.

As has been mentioned, the frame assembly can easily be disassembled for maintenance or pane replacement using a simple hand tool, such as a screwdriver blade. As shown in FIG. 8, the frame member 29 is provided with a longitudinal slot or opening 45 in general alignment with the tabs of the engagement element 33. The openings 45 provide access to the engagement elements so that a hand tool can be inserted within the openings to disengage the ratchet elements from the ratchet stops to allow the disassembly of the window frame members from within the opening in the garage door.

In the method of installing a window assembly within a garage door of the type described, the previously described window frame members are placed in the frame opening with a transparent pane sandwiched in between. While the figure illustrations show only a single transparent pane installed within the window frame assembly, it will be understood that a decorative trim insert could be installed, for example, in front of the pane 27 within the frame assembly. Such decorative trim assemblies are commercially available and known in the prior art. For example, such "Design Trim" is commercially available from National Door Industries, Inc. of Fort Worth, Tex.

The front and rear frame members 23, 29 are pressed together so that they are engaged in snap-fit fashion. If desired, the phantom holes 43 provided on the interior frame member can be drilled out and screws installed to add further structural integrity to the assembly. The frame assembly can be disassembled by using the previously described openings 45 on the rear frame member with a hand tool being inserted within the openings to disengage the ratchet elements from the ratchet stops to allow the disassembly of the window frame members from within the opening in the garage door. This action allows the removal of the existing transparent pane from between the two window frame members, whereby a new transparent pane can be installed between the two window frame members with the frame member then being again engaged within the garage door window opening.

An invention has been provided with several advantages. The garage door window frame assembly of the invention is simple in design and economical to manufacture using frame members from injected molded plastic. The front and rear frame members are provided with mating engagement means which allow the frame members to be engaged in snap-fit fashion by simply pressing the front and rear flame members together. It is not necessary to utilize a hammer or to assemble the frame members into a door section in a separate step as was often done in the prior art. The alignment elements make the job of lining up the respective frame members a very easy task. The nature of inter-engageable tabs and lips allows the engagement members to be easily released with a simple hand tool such a screwdriver blade so that the frame assembly can be disassembled for repair or replacement. The ratcheting action of the engagement elements allows the same frame to accommodate doors of varying thicknesses. The three levels of engagement accommodate garage doors (with insulation) that may fluctuate in thickness with the three levels ranging from +0.070 to −0.070 of the designated door thickness. The interior frames can accommodate, for example, doors ranging from a pan door with no insulation, to 1 inch, 1 ⅜ inch, 1 ⅞ inch and 2 inch doors with insulation. The frame can also accommodate various glass thicknesses ranging, for example, from 0.090 to 0.500 inches in thickness. The flexible compression leg provided on the inside perimeter of the inner frame member ensures constant pressure is applied on all four sides of the window glazing and ensures constant and even pressure on the garage door panel.

While the invention has been shown in one of its forms, it is not thus limited and is susceptible to various changes and modifications without departing from the spirit thereof.

We claim:

1. In combination, a garage door and window frame assembly, the combination comprising:

an overhead garage door having front and rear exposed surfaces separated by a door thickness, and at least one window opening therein;

a front window frame member formed in one piece of a synthetic, polymeric material and having a periphery sized to circumscribe the window opening from the front exposed surface of the door;

a rear window frame member also formed in one piece of a synthetic polymeric material and having a periphery sized to circumscribe the window opening from the rear exposed surface of the door, the front and rear window frame members having engagement elements located about the peripheries thereof which snap together in mating fashion to thereby mount the frame members within the window opening, the engagement elements also being disengageable with a hand tool to separate the frame members and remove the members from the window opening; and wherein the engagement elements include a plurality of ratchet elements on a selected one of the front and rear window frame members and a series of mating ratchet stops on the other of the respective front and rear frame members, the ratchet elements comprising two or more L-shaped detents of equal relative height and the mating ratchet stops comprising an equal number of stepped recesses of varying relative depths, the depths being designed to accommodate garage doors of varying thicknesses, whereby the front and rear window frame members snap together between a disengaged position and a series of engaged positions designed to accommodate garage doors of varying thicknesses, the first L-shaped detent and mating ratchet stop engaging to accommodate a garage door of a first relative thickness and the second L-shaped detent and mating ratchet stop engaging to accommodate a garage door of a second, lesser relative thickness.

2. The combination of claim 1, further comprising:

a central opening provided within each of the window frame members;

a transparent pane having peripheral edges sized to be received within the central opening provided in the window frame members and supported therein.

3. In combination, a garage door and window frame assembly, the combination comprising:

an overhead garage door having front and rear exposed surfaces separated by a door thickness, and at least one window opening therein;

a front window frame member formed in one piece of a synthetic, polymeric material and having a periphery sized to circumscribe the window opening from the front exposed surface of the door;

a rear window frame member also formed in one piece of a synthetic polymeric material and having a periphery sized to circumscribe the window opening from the rear exposed surface of the door, the front and rear window frame members having engagement elements located about the peripheries thereof which snap together in mating fashion to thereby mount the frame members within the window opening, the engagement elements also being disengageable with a hand tool to separate the frame members and remove the members from the window opening;

wherein the engagement elements include a plurality of ratchet elements on a selected one of the front and rear window frame members and a series of mating ratchet stops on the other of the respective front and rear frame members, the ratchet elements comprising two or more L-shaped detents of equal relative height and the mating ratchet stops comprising an equal number of stepped recesses of varying relative depths, the depths being designed to accommodate garage doors of varying thicknesses, whereby the front and rear window frame members snap together between a disengaged position and a series of engaged positions designed to accommodate garage doors of varying thicknesses, the first L-shaped detent and mating ratchet stop engaging to accommodate a garage door of a first relative thickness and the second L-shaped detent and mating ratchet stop engaging to accommodate a garage door of a second, lesser relative thickness; and wherein a series of alignment elements are provided on the front and rear window frame members, respectively, the alignment elements including a T-shaped bar on a selected one of the front and rear window frame members and a mating T-shaped channel provided on the other of the respective front and rear frame members, to provide ease of alignment between the front and rear frame member during assembly and to ensure minimal twisting of the window frame members during assembly.

4. In combination, a garage door and window frame assembly, the combination comprising:

an overhead garage door having front and rear exposed surfaces separated by a door thickness, and at least one window opening therein;

a front window frame member formed in one piece of a synthetic, polymeric material and having a peniphery sized to circumscribe the window opening from the front exposed surface of the door;

a rear window frame member also formed in one piece of a synthetic polymeric material and having a periphery sized to circumscribe the window opening from the rear exposed surface of the door, the front and rear window frame members having engagement elements located about the peripheries thereof which snap together in mating fashion to thereby mount the frame members within the window opening, the engagement elements also being disengageable with a hand tool to separate the frame members and remove the members from the window opening;

wherein the engagement elements include a plurality of ratchet elements on a selected one of the front and rear window frame members and a series of mating ratchet stops on the other of the respective front and rear frame members, the ratchet elements comprising two or more L-shaped detents of equal relative height and the mating ratchet stops comprising an equal number of stepped recesses of varying relative depths, the depths being designed to accommodate garage doors of varying thicknesses, whereby the front and rear window frame members snap together between a disengaged position and a series of engaged positions designed to accommodate garage doors of varying thicknesses, the first L-shaped detent and mating ratchet stop engaging to accommodate a garage door of a first relative thickness and the second L-shaped detent and mating ratchet stop engaging to accommodate a garage door of a second, lesser relative thickness; and wherein the rear window frame members are provided with a flexible compression leg that runs about an inside perimeter of the rear window frame, the compression leg contacting and compressing the window pane along a peripheral edge thereof, to thereby ensure a constant pressure is applied to the pane upon assembly.

5. The combination of claim 4, further comprising a series of phantom hole provided on the interior frame member, the phantom holes being aligned with mating screw bosses provided on the front frame member, whereby drilling through the phantom holes on the rear window frame allows screws to be installed into the bosses provided on the front frame member.

6. The combination of claim 5, wherein the rear frame member has openings provided therein in alignment with the engagement elements, the openings providing access to the engagement elements so that a hand tool can be inserted within the openings to disengage the ratchet elements from the ratchet stops to allow the disassembly of the window frame members from within the opening in the garage door.

* * * * *